United States Patent [19]

Melotti

[11] 4,334,383

[45] Jun. 15, 1982

[54] WATER SPRINKLING TOY PISTOL WITH BUBBLE-BLOWING RING

[76] Inventor: Athos Melotti, Via dello Spalto 3 -, Bologna, Italy

[21] Appl. No.: 191,967

[22] Filed: Sep. 29, 1980

[30] Foreign Application Priority Data

Oct. 15, 1979 [IT] Italy ..... 26498 A/79

[51] Int. Cl.[3] ..... A63H 33/28

[52] U.S. Cl. ..... 46/7; 222/79; 273/349

[58] Field of Search ..... 46/6–8; 273/349; 222/79

[56] References Cited

U.S. PATENT DOCUMENTS 2,832,173 4/1958 Winfield ..... 46/8

2,974,438 3/1961 Hopkins ..... 46/8

3,361,300 1/1968 Kaplan ..... 222/79 X 3,389,492 6/1968 Sullivan et al. ..... 46/7

*Primary Examiner*—F. Barry Shay

*Attorney, Agent, or Firm*—Guido Modiano; Albert Josif

[57] ABSTRACT

Water sprinkling toy pistol of the type which comprises a water magazine for insertion into the pistol grip. The water magazine is in communication with means for ejecting a sprinkle of water through the pistol barrel. Overlying the magazine is a reservoir for containing a liquid producing bubbles of the type of soap bubbles, wherein a bubble blowing ring is immersed. The bubble blowing ring can be raised from the reservoir, through supporting means guided inside the pistol grip, to delivery bubbles in the direction of the piston barrel.

5 Claims, 5 Drawing Figures

WATER SPRINKLING TOY PISTOL WITH BUBBLE-BLOWING RING

BACKGROUND OF THE INVENTION

This invention relates to a water sprinkling toy pistol.

Known are, for children to play with, toy pistols designed to eject a sprinkle or jet of water. Such pistols are generally molded from a plastic material in two symmetrical halves which are then united along the pistol centerplane, so that problems are often encountered as the proper sealing of the water charge stored in the pistol. Accordingly, improved design toy pistols have been developed which include a separate magazine-like reservoir generally-accommodated inside the pistol hand grip and of single-piece construction, thereby leakage problems are eliminated. A small pick-up tube is inserted into the magazine and connected to a small pump operated through the pistol trigger to eject a sprinkle of water.

However, such water sprinkling toy pistols, while being functionally satisfactory, fail to fully meet the playing requirements of children whose interest is mostly attracted by whatever appears to be promisingly new.

SUMMARY OF THE INVENTION

This invention sets out to provide a water sprinkling toy pistol, which can also be utilized to emit bubbles, such as soap bubbles, to widen the range of application of the toy.

Within that general aim, it is possible to arrange that the water sprinkling toy pistol of this invention is simple in design, reliable and safe to use, and adequately economical to make its manufacture cost-wise advantageous.

According to one aspect of the present invention, there is provided a water sprinkling toy pistol of the type which comprises a water magazine adapted for insertion into the pistol grip and in operative communication with means for ejecting a sprinkle of water from the pistol barrel, characterized in that it further comprises, located above said magazine, a reservoir intended for containing a liquid effective to produce bubbles of the type of soap bubbles, a bubble blowing ring immersed in said reservoir and adapted to be raised with the intermediary of supporting means guided within the pistol grip to deliver bubbles in the direction of the pistol barrel.

BRIEF DESCRIPTION OF THE DRAWINGS

Further details will become more apparent from the following description of some preferred embodiments of the toy pistol according to this invention, with reference to the accompanying exemplary drawings, where.

DESCRIPTION OF THE PREFERRED EMBODIMENTS

Figure 1:
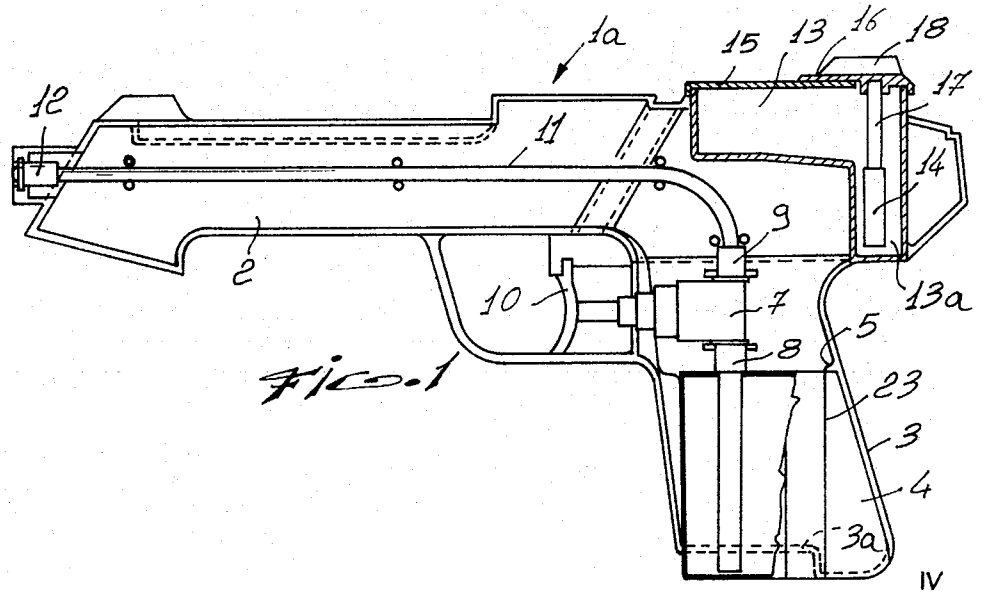
FIG. 1 is a sectional view, taken along a longitudinal centerplane of the pistol, showing the right-hand half of the pistol.
Figure 2:
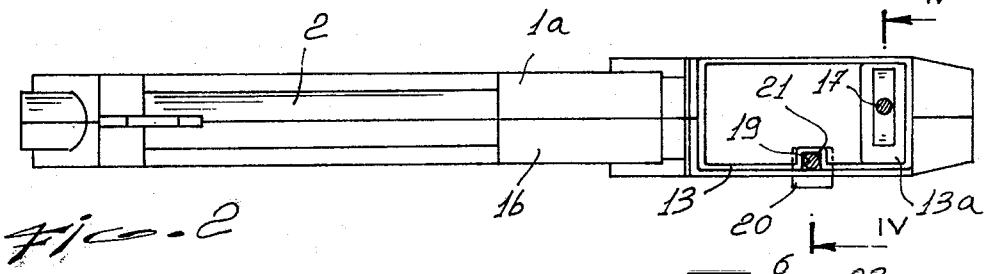
FIG. 2 is a plan view thereof, with some parts removed.
Figure 3:
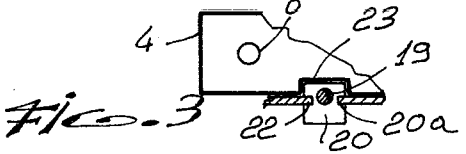
FIG. 3 is a fragmentary horizontal section through the grip of the pistol.
Figure 4:
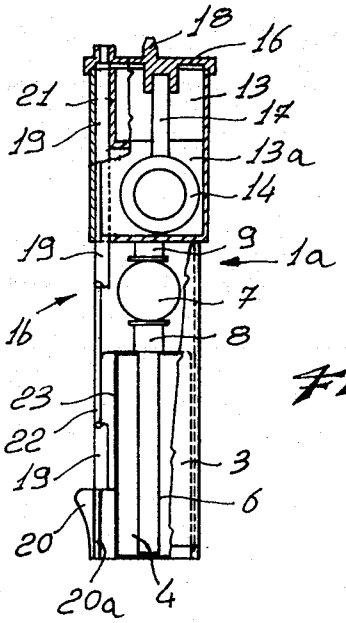
FIG. 4 is a vertical section through the pistol, taken along the line IV—IV of FIG. 2.

With reference initially to FIGS. 1 to 4, this water sprinkling toy pistol is made in two almost symmetrical halves or shells 1*a*, 1*b* molded from a plastics material; the two halves are joined together along the longitudinal centerplane of the pistol. The joint is implemented in a conventional manner, by insertion of pegs formed in one half into mating recesses formed in the other half. Also conventionally, the pistol has a barrel 2 and a hand grip 3 which may have any desired shape.

The butt of the grip 3 is left completely open for the pressure insertion therein, from the bottom, of a magazine 4 containing the water to be sprinkled. The magazine, which is also made of a plastics material, has a single-piece construction and a shape which practically matches that of the grip 3, it being flattened sideways and tapered toward the top at the rear face thereof. It is intended for insertion until it abuts against a projection 5 inside the grip 3. Once it has been so introduced, the magazine is still accessible for gripping and withdrawing it through cutouts 3*a* in the bottom edge of the grip.

The magazine 4 has at the top a loading hole wherethrough, in the assembled condition, a small vertical tube 6 is passed to reach the bottom of the magazine. The small tube 6 is connected to a small pump 7, which is interposed between check valves 8, 9 and operated through an axially sliding trigger 10. The tube 6 is extended beyond the pump 7 in a tube 11 which is coaxial with the barrel 2 of the pistol and terminates at the end of the barrel in a nozzle 12 for the ejection of the water sprinkle.

Above the grip 3, the half shell 1*a* of the pistol defines a reservoir 13 for a liquid effective to form bubbles of the type of soap bubbles. The reservoir 13 is open at the top and has a rear portion 13*a* of greater depth; this rear portion accommodates a bubble blowing ring 14 of the type effective to withhold said liquid by capillary action, such as to issue trains of bubbles.

The reservoir 13 is closed at the top, excepting for the rear portion 13*a*, by a cover or lid 15 which is pressure applied; that portion is in turn closed by a cap 16 which partly overlaps the cover 15 and to which the blowing ring 14 is attached through a small rod 17.

The cap 16 also defines a centrally located sight 18 for the pistol. The cap 16 can be raised by means of a shank 19 together with the blowing ring 14.

The shank 19, which is arranged vertically on the side of the pistol grip 3 corresponding to the left-hand part 1*b*, is secured to the cap or plug 16 at its top end, its bottom end being provided with a button 20 for raising it. The shank 19 is guided at its upper portion between a recess 21 in the wall of the reservoir 13 and the half-shell 1*b*; at the bottom, it slides in a cutout 22 on the wall of the grip 3, in which cutout it is slidably guided by means of two related side grooves 20*a* in the button 20.

Thus, the button 20 is partly within and partly without the grip 3. Correspondingly with the path followed by the button 20, inside the grip, the magazine 4 is formed with a groove 23.

Figure 5:
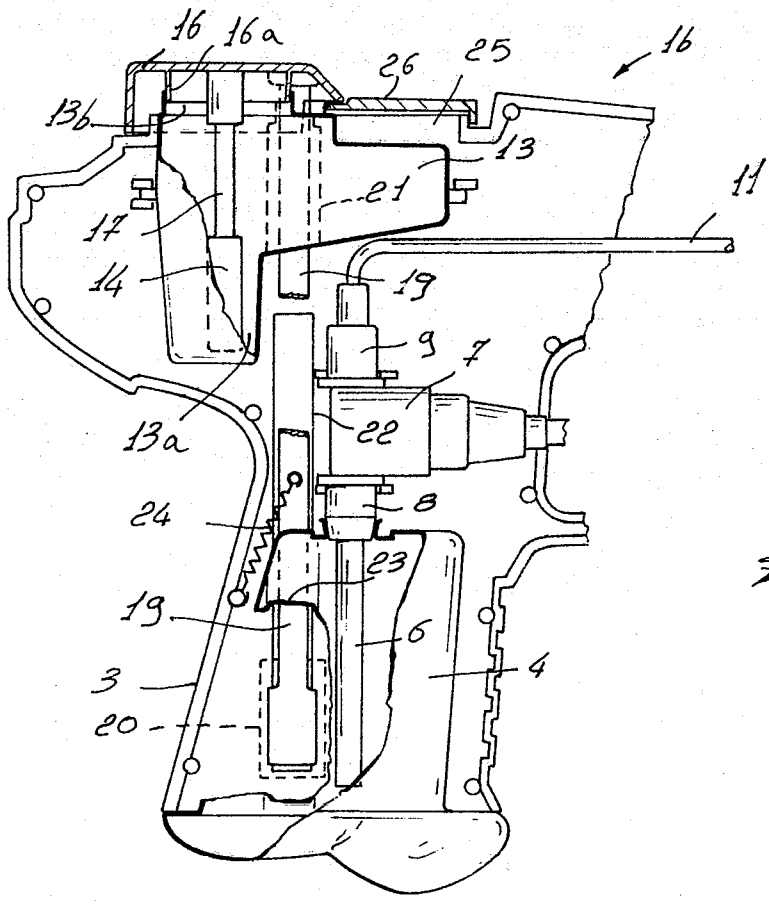
FIG. 5 is a fragmentary longitudinal midsectional view of a second embodiment of the toy pistol, showing the left-hand half of the pistol.

With reference to FIG. 5, where the same reference numerals are used to designate similar elements, it can be noted that, inside the grip 3, a tension spring 24 is provided which has one end connected to the grip and the other end to the shank 19. Under the action of the spring 24, the shank 19 and the cap 16 attached thereto are pulled downwards, thereby the tail portion 16*a* of the cap enters the mouth 13*b* of the reservoir 13 and forms a sealed connection against it. The tail portion 16*a*, which underlies the cap 16 and is aligned with the rod 17, has a slightly conical outer surface, converging downwards to create an effective seal. In the embodiment of FIG. 5, the reservoir 13 is a separate one-piece construction and, like the magazine 4, molded from a plastics material. The reservoir is locked inside the pistol, at an opening 25 at the top of the pistol; this opening is partly closed by the cover 26 and partly by the cap 16, when the latter is at the down position.

The operation of this toy pistol will be apparent from the foregoing description. After the magazine 4 has been filled with water and inserted into the grip 3, the water can be sprinkled by pulling the trigger which operates the pump. When the button 20 is pushed up to abut against the bottom edge of the wall of the half-shell 1*b*, which covers the recess 21, the bubble blowing ring 14 is raised above the cover 15 or 26. The ring 14 withholds the liquid, as loaded into the reservoir 13, such that, by blowing on it, a train of bubbles is emitted, of the type of soap bubbles, in the direction of the barrel 2 of the pistol. In the embodiment of FIG. 5, on releasing the button 20, the blowing ring 14 automatically returns to its submerged position in the reservoir 13, the shank 19 and cap 16 being moved back to their down position by the spring 24.

The toy pistol according to this invention is, therefore, capable of widening considerably the playing potentiality over traditional ones. By way of example, it will be possible to aim the water sprinkle at previously emitted bubbles. Moreover, this toy pistol fully meets its functional requisites, in particular on account of the magazine 4 and reservoir 13 being a single piece construction, thereby no leakage problems can occur.

The materials, shapes and dimensions of the invention may be any ones to suit individual requirements.

Furthermore, all of the details may be replaced by other technically equivalent ones.

I claim:

1. A water sprinkling toy pistol of the type which comprises a water magazine adapted for insertion into the pistol grip and in operative communication with means for ejecting a sprinkle of water from the pistol barrel, characterized in that it further comprises, located above said magazine, a reservoir intended for containing a liquid effective to produce bubbles of the type of soap bubbles, a bubble blowing ring immersed in said reservoir, said ring being movably mounted on said pistol and adapted to be raised by supporting means therefor guided within the pistol grip to a position to deliver bubbles in the direction of the pistol barrel.

2. A toy pistol according to claim 1, characterized in that said supporting means for said bubble blowing ring comprise a shank arranged vertically on one side of said grip and attached at the top end thereof to a cap for said reservoir, said cap carrying said bubble blowing ring.

3. A toy pistol according to claim 2, characterized in that said shank carries at the bottom end thereof an actuating button and is guided slidably along a recess in said reservoir and a cutout in said grip.

4. A toy pistol according to claim 2, characterized in that said cap is biased by a spring to tightly close the mouth of said reservoir, said spring being interposed between the pistol grip and said shank.

5. A toy pistol according to claim 1, characterized in that said reservoir is open at the top and has a deeper portion accommodating said bubble blowing ring.

* * * * *